US012446694B2

(12) United States Patent
Zhao et al.

(10) Patent No.: US 12,446,694 B2
(45) Date of Patent: Oct. 21, 2025

(54) ELECTRIC SEAT MECHANICAL EXTENSION DEVICE

(71) Applicant: Emomo Technology (Zhejiang) Co., Ltd., Huzhou (CN)

(72) Inventors: Yushu Zhao, Huzhou (CN); Wencai Li, Huzhou (CN); Kai Jin, Huzhou (CN)

(73) Assignee: Emomo Technology (Zhejiang) Co., Ltd., Huzhou (CN)

( * ) Notice: Subject to any disclaimer, the term of this patent is extended or adjusted under 35 U.S.C. 154(b) by 190 days.

(21) Appl. No.: 18/537,764

(22) Filed: Dec. 12, 2023

(65) Prior Publication Data

US 2025/0072612 A1 Mar. 6, 2025

(30) Foreign Application Priority Data

Aug. 28, 2023 (CN) ..... 202322314920.8

(51) Int. Cl.

| | |
|---|---|
| ***A47C 7/14*** | (2006.01) |
| ***A47C 1/024*** | (2006.01) |
| ***A47C 1/0355*** | (2013.01) |
| ***A47C 7/28*** | (2006.01) |

(52) U.S. Cl.

CPC ..... *A47C 1/0355* (2013.01)

(58) Field of Classification Search

CPC . A47C 1/0355; A47C 1/03211; A47C 1/0342; A47C 1/0345; A47C 1/0352; A47C 17/04; A47C 7/5068

USPC ..... 297/68

See application file for complete search history.

(56) References Cited

U.S. PATENT DOCUMENTS

| | | | | |
|---|---|---|---|---|
| 11,564,496 | B1 * | 1/2023 | Li | A47C 1/0355 |
| 11,564,498 | B1 * | 1/2023 | Li | A47C 17/04 |
| 11,638,483 | B2 * | 5/2023 | Sun | A47C 1/03211 297/75 |
| 11,766,123 | B2 * | 9/2023 | Feng | A47C 17/04 297/68 |
| 12,207,731 | B2 * | 1/2025 | Yang | A47C 17/163 |
| 2014/0132038 | A1 * | 5/2014 | Lu | A47C 1/035 297/68 |

(Continued)

FOREIGN PATENT DOCUMENTS

CN 103932521 A 7/2014

*Primary Examiner* — Shin H Kim

(74) *Attorney, Agent, or Firm* — Bayramoglu Law Offices LLC

(57) ABSTRACT

A backrest-seat assembly of an electric seat mechanical extension device includes a seat panel, a linkage, a front connecting piece, a back connecting piece, a mounting member, a support wheel control member, a backrest adjusting member, a backrest control member and a backrest member. The back connecting piece is fixedly mounted on the seat panel, the backrest member and the front connecting piece are rotatably mounted on the seat panel, the front connecting piece is articulated with the mounting member, the mounting member is mounted on a base, the mounting member is articulated with the support wheel control member and the backrest adjusting member, the backrest adjusting member is articulated with the back connecting piece and the backrest control member, the backrest adjusting member is articulated with the linkage, the linkage is articulated with a leg assembly, the backrest control member is articulated with the backrest member.

6 Claims, 4 Drawing Sheets

(56) References Cited

U.S. PATENT DOCUMENTS

| | | | | |
|---|---|---|---|---|
| 2015/0289655 | A1* | 10/2015 | Lawson | A47C 1/0342 297/75 |
| 2017/0135486 | A9* | 5/2017 | Lawson | A47C 7/00 |
| 2021/0219725 | A1* | 7/2021 | Sun | A47C 1/03211 |
| 2022/0039558 | A1* | 2/2022 | Zhang | A47C 7/5068 |
| 2022/0071396 | A1* | 3/2022 | Zhang | A61G 5/128 |
| 2022/0125200 | A1* | 4/2022 | Zhang | A47C 1/028 |
| 2022/0361674 | A1* | 11/2022 | Li | A47C 1/0355 |
| 2023/0172356 | A1* | 6/2023 | Feng | A47C 1/0342 297/68 |
| 2025/0072612 | A1* | 3/2025 | Zhao | A47C 1/03211 |

* cited by examiner

ELECTRIC SEAT MECHANICAL EXTENSION DEVICE

CROSS REFERENCE TO THE RELATED APPLICATIONS

This application is based upon and claims priority to Chinese Patent Application No. 202322314920.8, filed on Aug. 28, 2023, the entire contents of which are incorporated herein by reference.

TECHNICAL FIELD

The application relates to an electric seat mechanical extension device, which is mainly suitable for the design and application of electric seats.

BACKGROUND

Referring to the patent application document Application No. CN201410202457.0, entitled "Electric Seat Mechanical Extension Device of Mobile Sofa", the electric seat mechanical extension device has three problems: 1, a seat undergoes an intermediate state in the unfolding and folding process, that is, the backrest is still in a sitting position after the leg parts are unfolded, as shown in FIG. 3 in the reference document, so the seat cannot be unfolded and folded smoothly, and the intermediate state is impractical and unnatural; 2, such a design leads to a relatively complex structure and a higher production cost of the electric seat; 3, in a lying position, a user sitting on the seat is supported mainly by a base, and when the user lies back drastically, the seat has a risk of overturning backward, and related pressure-bearing parts are likely to be damaged.

SUMMARY

The technical issue to be settled by the application is to overcome the abovementioned defects in the prior art by providing an electric seat mechanical extension device which has a simple structure, can be unfolded and folded smoothly, and is low in production cost and high in reliability.

The technical solution adopted by the application to settle the above technical issue is as follows: an electric seat mechanical extension device comprises two bilaterally symmetrical mechanical extending units, and a front driving member and a back driving member for connecting the two mechanical extending units, a motor is articulated with the front driving member and the back driving member, the front driving member is mounted on leg assemblies, the back driving member is mounted on seat panels, and each of the mechanical extending units comprises one of the leg assemblies for stretching and retracting legs and feet, and a backrest-seat assembly for position adjustment of a backrest and a seat, wherein the backrest-seat assembly includes a seat panel, a linkage, a front connecting piece, a back connecting piece, a mounting member, a support wheel control member, a backrest adjusting member, a backrest control member and a backrest member, the back connecting piece is fixedly mounted on the seat panel, the backrest member and one end of the front connecting piece are rotatably mounted on the seat panel, the other end of the front connecting piece is articulated with the mounting member, the mounting member is mounted on a base through a mounting member fixing pin assembly, a rear portion of the mounting member is articulated with the support wheel control member, the mounting member is articulated with the backrest adjusting member, the backrest adjusting member is articulated with the back connecting piece and articulated with one end of the backrest control member, the backrest adjusting member is articulated with the linkage, the linkage is articulated with the corresponding leg assembly, a middle of the backrest control member is articulated with the backrest member, a backrest control member positioning pin is arranged at the other end of the backrest control member, a support wheel control member positioning slot is formed in one end of the support wheel control member, a support wheel is mounted at the other end of the support wheel control member, and the support wheel comes into contact with the base in a lying position to support a rear portion of the backrest-seat assembly together with the base, thus preventing the electric seat mechanical extension device from overturning backward and/or preventing relevant parts from being damaged.

In the application, the rear portion of the mounting member is articulated with the support wheel control member through a support wheel driving pin, the mounting member is articulated with the backrest adjusting member through a backrest adjusting member positioning pin, the backrest adjusting member is articulated with the back connecting piece through a backrest adjusting member mounting pin and articulated with said end of the backrest control member through a backrest adjusting pin, the backrest adjusting member is articulated with the linkage through a linkage back pin, the linkage is articulated with the corresponding leg assembly through a linkage front pin, and the middle of the backrest control member is articulated with the backrest member through a backrest control pin.

In the application, by simplifying the structure, continuous and smooth position adjustment of the seat panels and the backrest members are realized and controlled merely through the linkages, the front connecting pieces, the back connecting pieces, the mounting members, the support wheel control members, the backrest adjusting members and the backrest control members, thus greatly reducing the production cost and failure rate, and improving product reliability.

In the application, the mounting member fixing pin assembly includes a first mounting member fixing pin, a second mounting member fixing pin and a third mounting member fixing pin, a base fixing groove assembly is arranged on the base and includes a first base fixing groove, a second base fixing groove and a third base fixing groove, the first mounting member fixing pin is mounted in a fixing hole in the first base fixing groove, and the second mounting member fixing pin and the third mounting member fixing pin are located in the second base fixing groove and the third base fixing groove respectively. In a particular case, five fixing holes are arranged in the first base fixing groove side by side, such that the electric seat mechanical extension device, after being assembled, can have five specifications which are slightly different in front-back position.

In the application, the support wheel control member is Z-shaped, and in the lying position, a connecting line between a central point of a support wheel driving pin and a central point of a support wheel mounting pin is perpendicular to a contact surface between the base and the support wheel to assist in supporting a load applied to the rear portion of a seat.

In the application, each of the leg assemblies comprises a first leg link, a second leg link, a third leg link, a fourth leg link and a footrest, one end of the first leg link is articulated with the corresponding seat panel, the other end of the first leg link is articulated with one end of the fourth leg link, the first leg link is connected to the front driving member, one end of the second leg link is articulated with the linkage, the other end of the second leg link is articulated with one end of the third leg link, the other end of the third leg link and the other end of the fourth leg link are articulated with the footrest, and the first leg link is articulated with the third leg link through a leg flexible pin to drive the leg assembly to be unfolded and folded.

Compared with the prior art, the application has the following advantages and effects: the electric seat mechanical extension device has a simple structure, can be unfolded and folded smoothly, and is low in production cost and high in reliability.

In the figures: 1, base; 2, motor; 3, seat panel; 31, backrest mounting pin; 32, front connecting piece mounting pin; 4, front driving member; 5, back driving member; 6, linkage; 61, linkage back pin; 62, linkage front pin; 7, front connecting piece; 8, back connecting piece; 81, backrest adjusting member mounting pin; 9, mounting member; 91, support wheel driving pin; 92, mounting member fixing pin assembly; 921, first mounting member fixing pin; 922, second mounting member fixing pin; 923, third mounting member fixing pin; 93, backrest adjusting member positioning pin; 94, front connecting piece positioning pin; 10, support wheel control member; 101, support wheel control member positioning slot; 102, support wheel mounting pin; 103, support wheel; 11, backrest adjusting member; 111, backrest adjusting pin; 12, backrest control member; 121, backrest control pin; 122, backrest control member positioning pin; 13, backrest member; 14, first leg link; 141, leg flexible pin; 15, second leg link; 16, third leg link; 17, fourth leg link; 18, footrest; 19, base fixing groove assembly; 191, first base fixing groove; 1911, fixing hole; 192, second base fixing groove; 193, third base fixing groove; 20, mechanical extending unit; 201, leg assembly; 202, backrest-seat assembly.

DETAILED DESCRIPTION OF THE EMBODIMENTS

Figure 3:
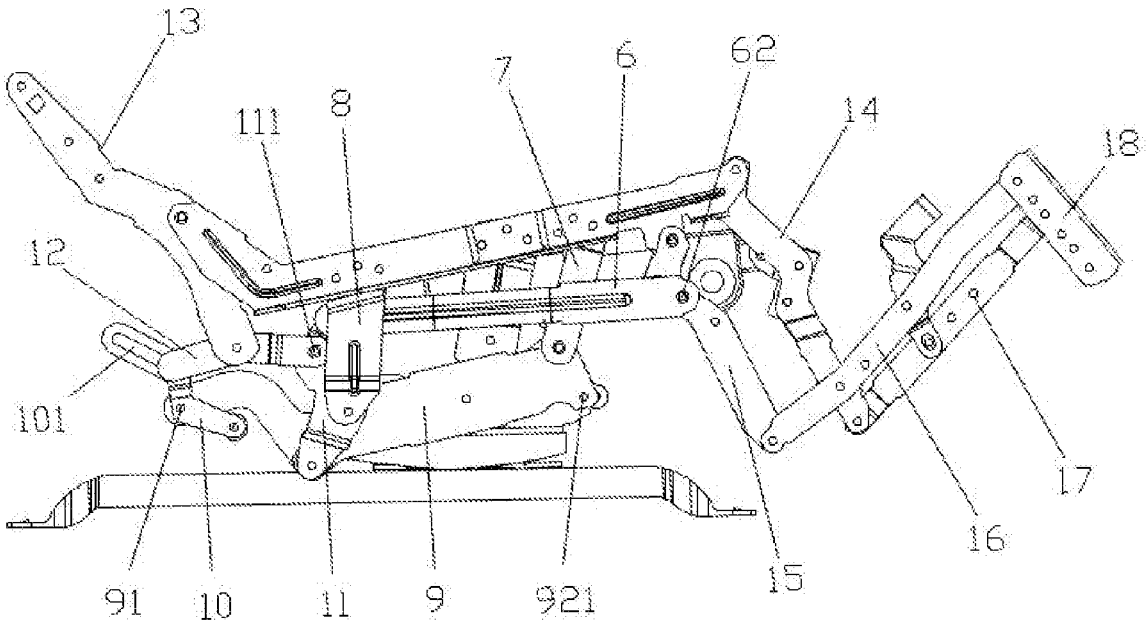
FIG. 3 is a schematic side view according to an embodiment of the application in an intermediate state.
Figure 4:
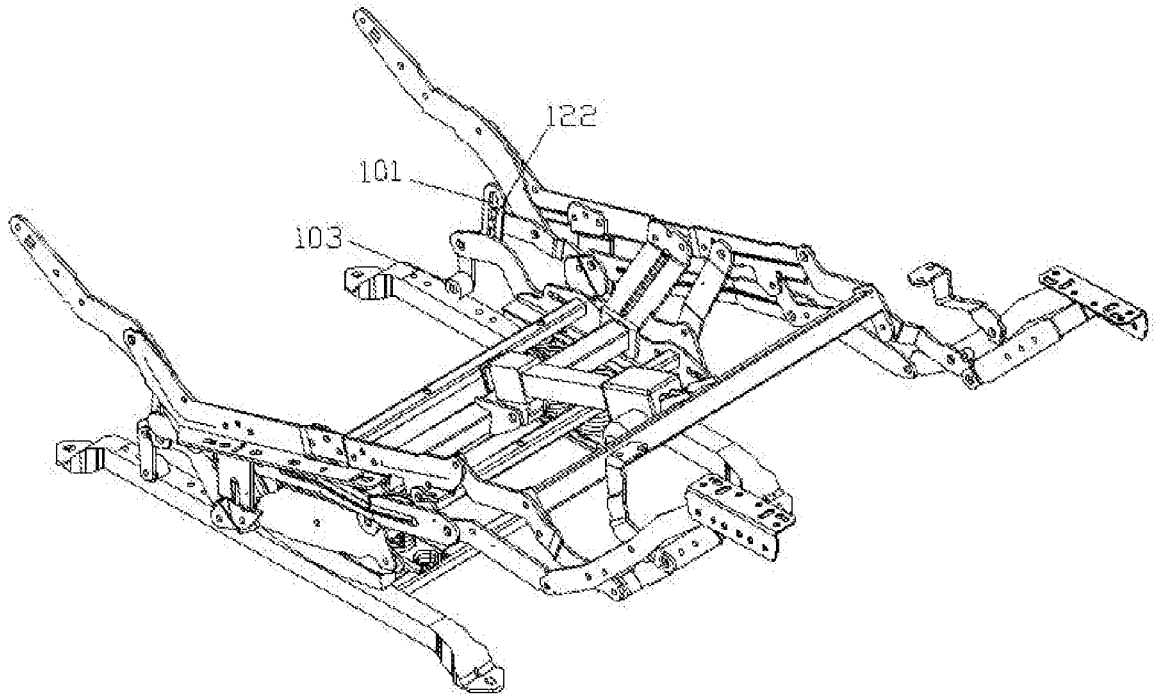
FIG. 4 is a schematic three-dimensional view according to an embodiment of the application in a lying position.
Figure 5:
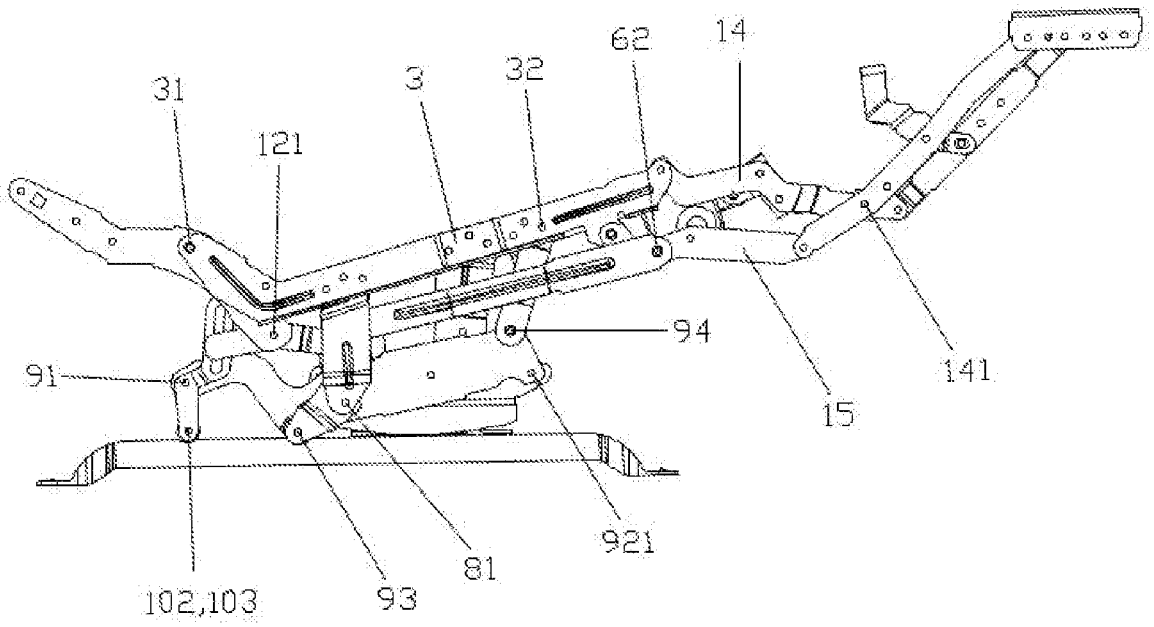
FIG. 5 is a schematic external view according to an embodiment of the application in the lying position.
Figure 6:
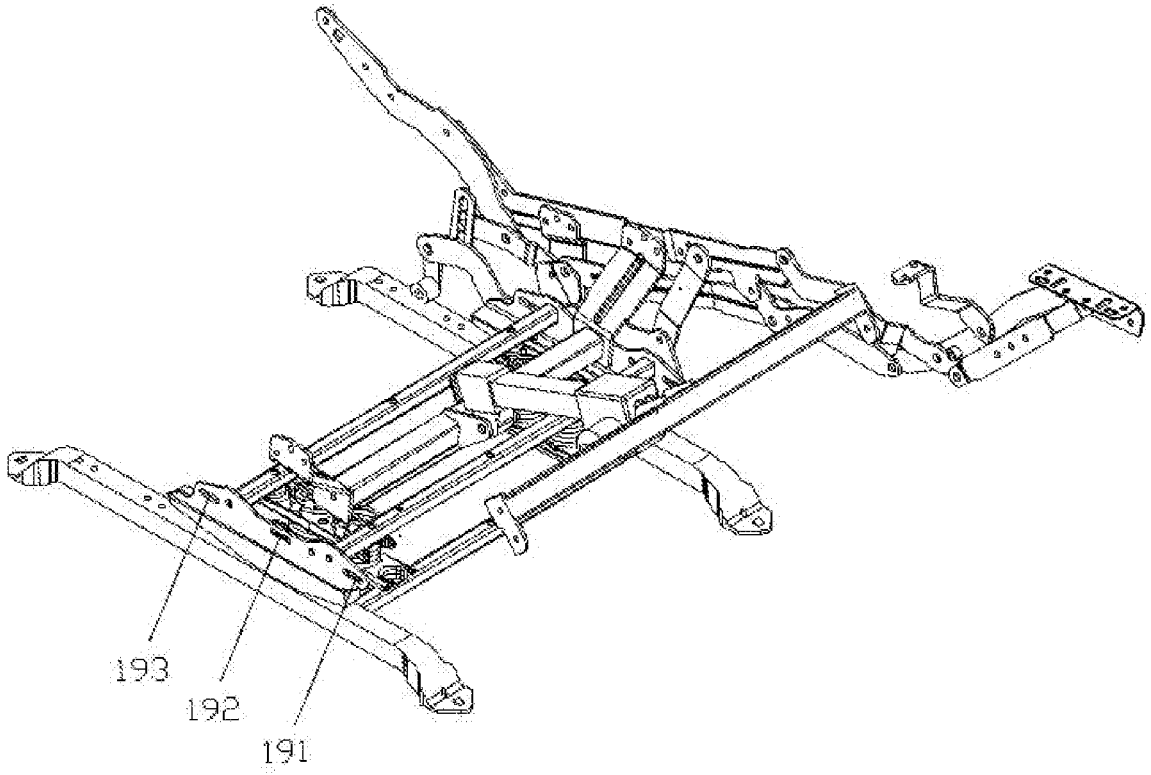
FIG. 6 is a partial three-dimensional view according to an embodiment of the application in the lying position.
Figure 7:
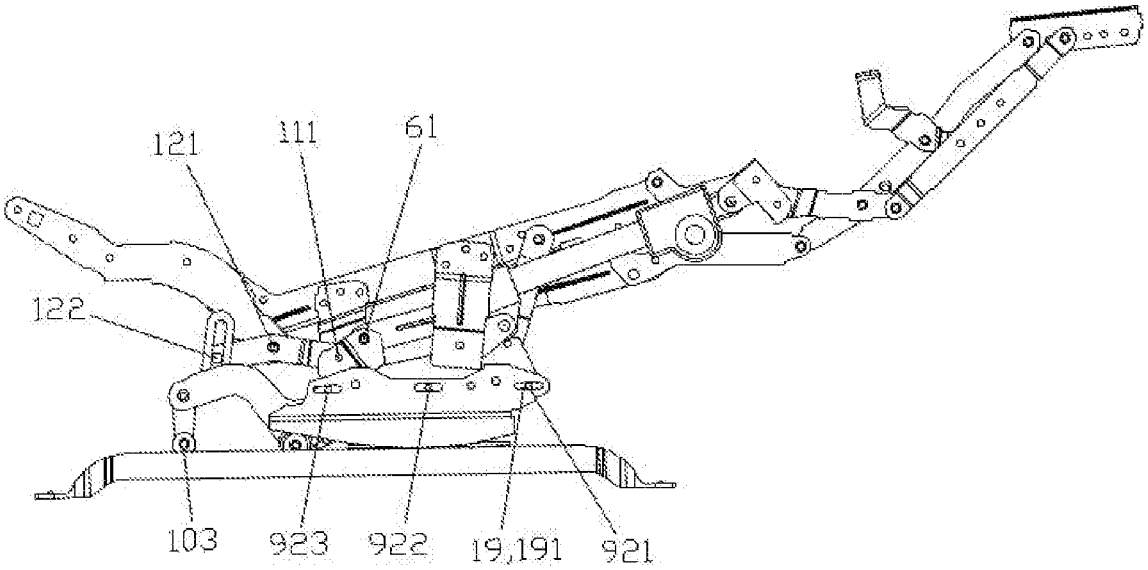
FIG. 7 is a schematic internal view according to an embodiment of the application in the lying position.

The application will be described in further detail below in conjunction with accompanying drawings and embodiments. The following embodiments are used to explain the application, and are not intended to limit the application. In the application, "front" and "back" are defined based on FIG. 3, and in FIG. 3, the left is "back" and the right is "front".

Referring to FIGS. 1-8, an embodiment of the application provides an electric seat mechanical extension device, which mainly comprises two bilaterally symmetrical mechanical extending units 20, and a front driving member 4 and a back driving member 5 for connecting the two mechanical extending units 20, wherein a motor 2 is articulated with the front driving member 4 and the back driving member 5 respectively, the front driving member 4 is mounted on first leg links 14 of leg assemblies 201, and the back driving member 5 is mounted on seat panel 3; each of the mechanical extending units 20 mainly comprises one of the leg assemblies 201 for stretching or retracting legs and feet, and a backrest-seat assembly 202 for position adjustment of a backrest and a seat. Compared with the reference document, the design of the application is mainly improved in the backrest-seat assemblies 202. Each of the backrest-seat assembly 202 is provided with a seat panel 3, a linkage 6, a front connecting piece 7, a back connecting piece 8, a mounting member 9, a support wheel control member 10, a backrest adjusting member 11, a backrest control member 12 and a backrest member 13, wherein the back connecting piece 8 is fixedly mounted on the seat panel 3, the backrest member 13 and one end of the front connecting piece 7 are rotatably mounted on the seat panel 3 through a backrest mounting pin 31 and a front connecting piece mounting pin 32 respectively, the other end of the front connecting piece 7 is articulated with the mounting member 9 through a front connecting piece positioning pin 94, the mounting member 9 is mounted on a base 1 through a mounting member fixing pin assembly 92, a rear portion of the mounting member 9 is articulated with the support wheel control member 10 through a support wheel driving pin 91, the mounting member 9 is articulated with the backrest adjusting member 11 through a backrest adjusting member positioning pin 93, the backrest adjusting member 11 is articulated with the back connecting piece 8 through a backrest adjusting member mounting pin 81 and articulated with one end of the backrest control member 13 through a backrest adjusting pin 111, the backrest adjusting member 11 is articulated with the linkage 6 through a linkage back pin 61 and articulated with a second leg link 15 of the corresponding leg assembly 201 through a linkage front pin 62, the middle of the backrest control member 12 is articulated with the backrest member 13 through a backrest control pin 121, a backrest control member positioning pin 122 is arranged at the other end of the backrest control member 12, a support wheel control member positioning slot 101 is formed in one end of the support wheel control member 10, a support wheel 103 is mounted at the other end of the support wheel control member 10 through a support wheel mounting pin 102, and in this embodiment, when the electric seat mechanical extension device is completely unfolded (in a lying position), the support wheel 103 comes into contact with the base 1 to support a rear portion of the backrest-seat assembly 202 together with the base 1, thus preventing the electric seat mechanical extension device from overturning backward and/or preventing related parts from being damaged.

In the application, by simplifying the structure, continuous and smooth position adjustment of the seat panels 3 and the backrest members 13 are realized and controlled merely through the linkages 6, the front connecting pieces 7, the back connecting pieces 8, the mounting members 9, the support wheel control members 10, the backrest adjusting members 11 and the backrest control members 12, thus greatly reducing the production cost and failure rate, and improving product reliability.

The leg assembly 201 in the application belongs to the prior art, one end of the first leg link 14 is articulated with the seat panel 3, the other end of the first leg link 14 is articulated with one end of a fourth leg link 17, one end of the second leg link 15 is articulated with the linkage 6, the other end of the second leg link 15 is articulated with one end of a third leg link 16, the other end of the third leg link 16 and the other end of the fourth leg link 17 are articulated with a footrest 18, the first leg link 14 is articulated with the third leg link 16 through a leg flexible pin 141 to drive the leg assembly 201 to be unfolded and folded.

Figure 1:
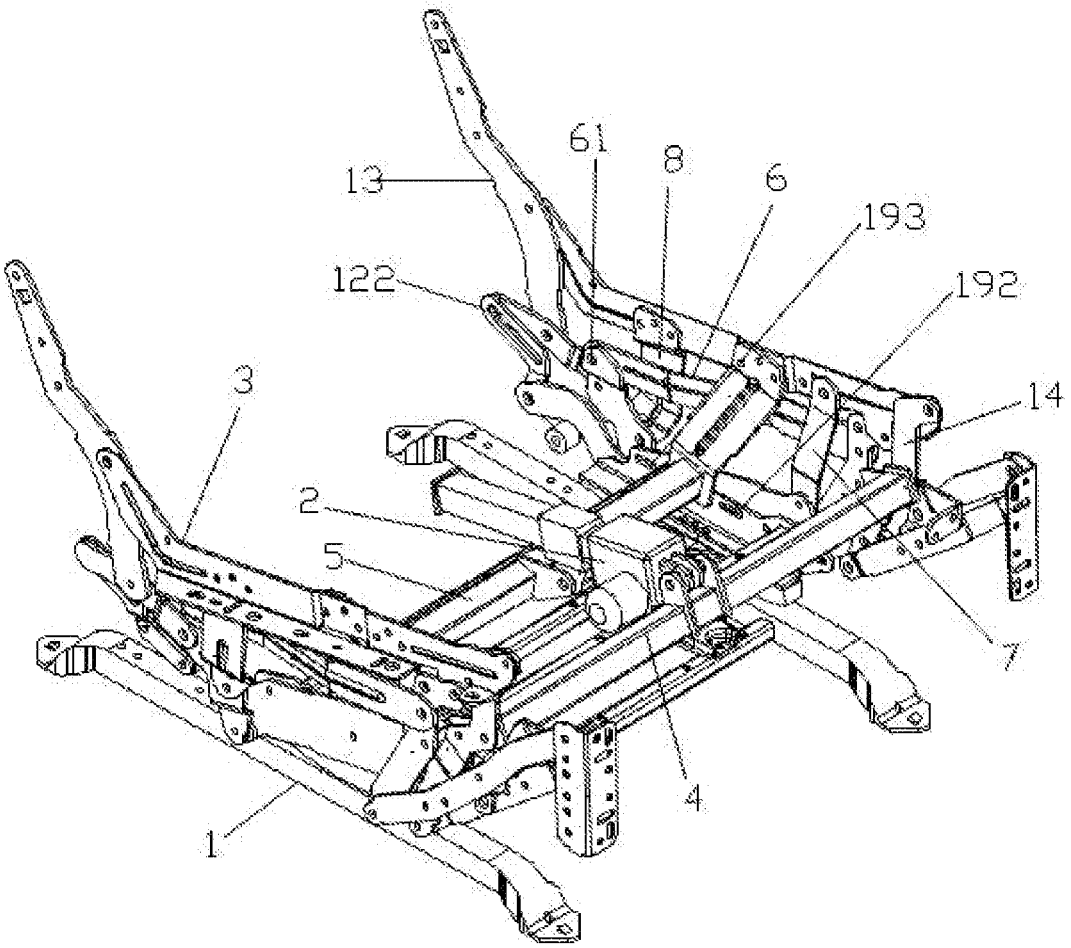
FIG. 1 is a schematic three-dimensional view in a sitting position according to an embodiment of the application.
Figure 2:
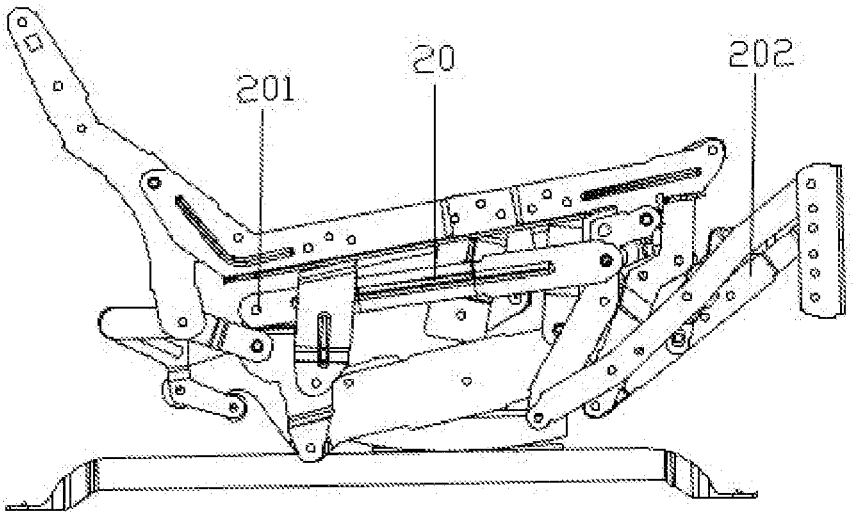
FIG. 2 is a schematic side view according to an embodiment of the application in a sitting position.

Referring to FIG. 1-FIG. 7 which illustrate the change process of the electric seat mechanical extension device of the application from a sitting position to a lying position, a user controls a motor button to drive the motor 2 to operate, the motor 2 then drives the front driving member 4 to move forward to drive the first leg links 14 to rotate forward, and the leg assemblies 201 are thus driven to unfold forward. In this process, the second leg links 15 drive the linkages 6 to move forward to drive upper portions of the backrest adjusting members 11 articulated with the linkages 6 to move forward, so as to drive the backrest control members 12 articulated with the backrest adjusting members 11 to move forward. The forward movement of the backrest control members 12 drives the backrest members 13 articulated with the backrest control members 12 to change to the lying position on the one hand and on the other hand, also drives the backrest control member positioning pins 122 located at far ends of the support wheel control member positioning slots 101 in the sitting position (shown in FIG. 1) to move towards near ends, close to the middle of the backrest control members 12, of the support wheel control member positioning slots 101 (shown in FIG. 4), and at the same time, the support wheels 103 gradually turn to a support state (FIG. 4) from a retracted state (FIG. 1). In this way, the leg assemblies 201 and the backrest-seat assemblies 202 are synchronously unfolded without an intermediate transition state, and the motor 2 can be stopped at any position in the unfolding process of the electric seat mechanical extension device to hold the electric seat mechanical extension device in a most comfortable position desired by the user.

Figure 8:
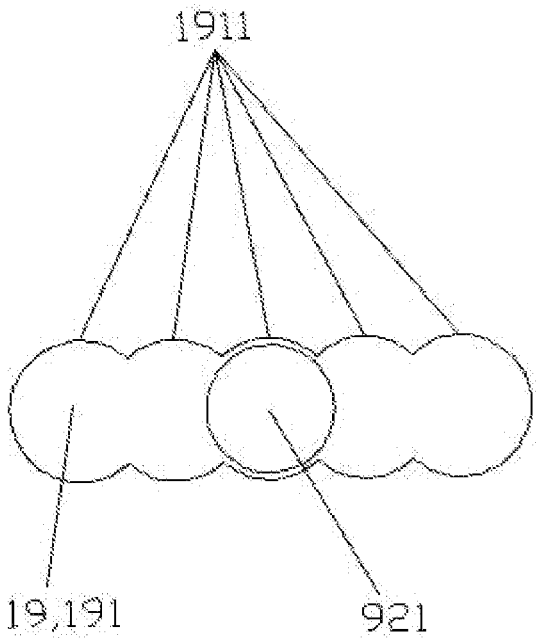
FIG. 8 is an enlarged installation and configuration view of a first mounting member fixing pin arranged in a first base fixing groove according to an embodiment of the application.

In the application, the mounting member fixing pin assembly 92 includes a first mounting member fixing pin 921, a second mounting member fixing pin 922 and a third mounting member fixing pin 923; a base fixing groove assembly 19 includes a first base fixing groove 191, a second base fixing groove 192 and a third base fixing groove 193, wherein the first mounting member fixing pin 921 is mounted in a fixing hole 1911 in the first base fixing groove 191, and the second mounting member fixing pin 922 and the third mounting member fixing pin 923 are located in the second base fixing groove 192 and the third base fixing groove 193 respectively, specifically corresponding to the first mounting member fixing pin 921 in the first base fixing groove 191. In a particular case, five fixing holes 1911 are arranged in the first base fixing groove 191 side by side, such that the electric seat mechanical extension device, after being assembled, can have five specifications which are slightly different in front-back position, as shown in FIG. 8.

In the application, the support wheel control member 10 is approximately Z-shaped, and in the lying position, a connecting line between a central point of the support wheel driving pin 91 and a central point of the support wheel mounting pin 102 is perpendicular to or approximately perpendicular to a contact surface between the base 1 and the support wheel 103 to assist in supporting a load applied to the rear portion of the electric seat mechanical extension device in this embodiment.

What is claimed is:

1. An electric seat mechanical extension device, comprising two bilaterally symmetrical mechanical extending units, a front driving member and a back driving member, wherein the front driving member and the back driving member are configured for connecting the two bilaterally symmetrical mechanical extending units, a motor is articulated with the front driving member and the back driving member, the front driving member is mounted on leg assemblies, the back driving member is mounted on a seat panel, each of the two bilaterally symmetrical mechanical extending units comprises a leg assembly and a backrest-seat assembly, the backrest-seat assembly comprises the seat panel, a linkage, a front connecting piece, a back connecting piece, a mounting member, a support wheel control member, a backrest adjusting member, a backrest control member and a backrest member, the back connecting piece is fixedly mounted on the seat panel, the backrest member and a first end of the front connecting piece are rotatably mounted on the seat panel, a second end of the front connecting piece is articulated with the mounting member, the mounting member is mounted on a base through a mounting member fixing pin assembly, a rear portion of the mounting member is articulated with the support wheel control member, the mounting member is articulated with the backrest adjusting member, the backrest adjusting member is articulated with the back connecting piece and articulated with a first end of the backrest control member, the backrest adjusting member is articulated with the linkage, the linkage is articulated with the corresponding leg assembly, a middle of the backrest control member is articulated with the backrest member, a backrest control member positioning pin is arranged at a second end of the backrest control member, a support wheel control member positioning slot is formed in a first end of the support wheel control member, a support wheel is mounted at a second end of the support wheel control member, and the support wheel comes into contact with the base in a lying position.

2. The electric seat mechanical extension device according to claim 1, wherein the rear portion of the mounting member is articulated with the support wheel control member through a support wheel driving pin, the mounting member is articulated with the backrest adjusting member through a backrest adjusting member positioning pin, the backrest adjusting member is articulated with the back connecting piece through a backrest adjusting member mounting pin and articulated with the first end of the backrest control member through a backrest adjusting pin, the backrest adjusting member is articulated with the linkage through a linkage back pin, the linkage is articulated with the corresponding leg assembly through a linkage front pin, and the middle of the backrest control member is articulated with the backrest member through a backrest control pin.

3. The electric seat mechanical extension device according to claim 1, wherein the mounting member fixing pin assembly comprises a first mounting member fixing pin, a second mounting member fixing pin and a third mounting member fixing pin, a base fixing groove assembly is arranged on the base and comprises a first base fixing groove, a second base fixing groove and a third base fixing groove, the first mounting member fixing pin is mounted in a fixing hole in the first base fixing groove, and the second mounting member fixing pin and the third mounting member fixing pin are located in the second base fixing groove and the third base fixing groove respectively.

4. The electric seat mechanical extension device according to claim 3, wherein five fixing holes are arranged in the first base fixing groove side by side.

5. The electric seat mechanical extension device according to claim 1, wherein the support wheel control member is Z-shaped, and in the lying position, a connecting line between a central point of a support wheel driving pin and a central point of a support wheel mounting pin is perpendicular to a contact surface between the base and the support wheel.

6. The electric seat mechanical extension device according to claim 1, wherein each of the leg assemblies comprises a first leg link, a second leg link, a third leg link, a fourth leg link and a footrest, a first end of the first leg link is articulated with the corresponding seat panel, a second end of the first leg link is articulated with a first end of the fourth leg link, the first leg link is connected to the front driving member, a first end of the second leg link is articulated with the linkage, a second end of the second leg link is articulated with a first end of the third leg link, a second end of the third leg link and a second end of the fourth leg link are articulated with the footrest, and the first leg link is articulated with the third leg link through a leg flexible pin.

* * * * *